US007644691B2

(12) United States Patent
Schafer et al.

(10) Patent No.: US 7,644,691 B2
(45) Date of Patent: Jan. 12, 2010

(54) DEVICE FOR MODIFYING THE CONTROL TIMES OF AN INTERNAL COMBUSTION ENGINE

(75) Inventors: Jens Schafer, Herzogenaurach (DE); Mike Kohrs, Wilthen (DE)

(73) Assignee: Schaeffler KG, Herzogenaurach (DE)

( * ) Notice: Subject to any disclaimer, the term of this patent is extended or adjusted under 35 U.S.C. 154(b) by 252 days.

(21) Appl. No.: 11/721,454

(22) PCT Filed: Nov. 11, 2005

(86) PCT No.: PCT/EP2005/012093

§ 371 (c)(1),
(2), (4) Date: Jun. 12, 2007

(87) PCT Pub. No.: WO2006/074733

PCT Pub. Date: Jul. 20, 2006

(65) Prior Publication Data

US 2008/0236527 A1 Oct. 2, 2008

(30) Foreign Application Priority Data

Dec. 23, 2004 (DE) ..... 10 2004 062 072

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

FOREIGN PATENT DOCUMENTS

| | | |
|---|---|---|
| DE | 4210038 | 9/1993 |
| DE | 10143794 | 1/2003 |
| DE | 10236507 | 2/2004 |
| EP | 0558200 | 8/2005 |
| WO | WO 2005008034 | 1/2005 |
| WO | WO 2006039884 | 4/2006 |

*Primary Examiner*—Ching Chang
(74) *Attorney, Agent, or Firm*—Volpe and Koenig, P.C.

(57) ABSTRACT

A device (1) for varying the control times of an internal combustion engine (100) is provided. A device (1) is proposed, with a means for limiting the angle of rotation, this being optimized in terms of the magnitude of the transmittable forces. A further aspect of the invention relates to making the mounting of the device (1) more flexible to the effect that the same components can be used in devices (1) with different relative angle-of-rotation ranges.

11 Claims, 11 Drawing Sheets

DEVICE FOR MODIFYING THE CONTROL TIMES OF AN INTERNAL COMBUSTION ENGINE

FIELD OF THE INVENTION

The invention relates to a device for varying the control times of gas exchange valves of an internal combustion engine.

BACKGROUND OF THE INVENTION

In internal combustion engines, camshafts are used for actuating the gas exchange valves. Camshafts are mounted in the internal combustion engine in such a way that cams attached to them bear against cam followers, for example bucket tappets, drag levers or rocker arms. When the camshaft is set in rotation, the cams roll on the cam followers which in turn actuate the gas exchange valves. Thus, owing to the position and shape of the cams, both the opening duration and amplitude, but also the opening and closing time point of the gas exchange valves are defined.

Modern engine concepts tend toward a variable design of the valve drive. On the one hand, the valve stroke and valve opening duration are to be capable of being configured variably up to the complete cut-off of individual cylinders. For this purpose, concepts, such as switchable cam followers, variable valve drives or electro-hydraulic or electric valve actuations, are provided. Furthermore, it has proved advantageous to be able to exert influence on the opening and closing times for the gas exchange valves while the internal combustion engine is in operation. It is likewise desirable to be able to influence the opening and closing time points of the inlet and outlet valves separately so that, for example, a defined valve overlap can be set in a directed way. By the opening and closing time points of the gas exchange valves being set as a function of the current characteristic map range of the engine, for example of the current rotational speed or the current load, the specific fuel consumption can be lowered, the exhaust gas behavior can be influenced positively and the engine efficiency, maximum torque and maximum power can be increased.

The variability in the gas exchange valve time control, as described, is brought about by means of a relative change in the phase position of the camshaft with respect to the crankshaft. In this case, the camshaft is mostly drive-connected to the crankshaft via a chain, belt or gearwheel mechanism or identically acting drive concepts. Between the chain, belt or gearwheel mechanism driven by the crankshaft and the camshaft is mounted a camshaft adjuster which transmits the torque from the crankshaft to the camshaft. In this case, this device for varying the control times of the internal combustion engine is designed in such a way that, while the internal combustion engine is in operation, the phase position between the crankshaft and camshaft can be maintained reliably, and, if desired, the camshaft can be rotated within a certain angular range with respect to the crankshaft.

In internal combustion engines with a camshaft in each case for the intake and the exhaust valves, these may be equipped in each case with a camshaft adjuster. As a result, the opening and closing times of the intake and exhaust gas exchange valves can be displaced relative to one another in time and the valve time overlaps can be set in a directed way.

The seat of modern camshaft adjuster is generally located at the drive-side end of the camshaft. It consists of a crankshaft-fixed driving wheel, of a camshaft-fixed driven element and of an adjusting mechanism transmitting the torque from the driving wheel to the driven part. The driving wheel may be designed as a chain wheel, belt wheel or gearwheel and is connected fixedly in terms of rotation to the crankshaft by means of a chain, a belt or a gearwheel mechanism. The adjusting mechanism may be operated electromagnetically, hydraulically or pneumatically. It is likewise conceivable to attach the camshaft adjuster to an intermediate shaft or to mount it on a nonrotating component. In this case, the torque is transmitted to the camshafts via further drives.

Electrically operated camshaft adjusters consist of a driving wheel which is drive-connected to the crankshaft of the internal combustion engine, of a driven part which is drive-connected to a camshaft of the internal combustion engine and of an adjusting mechanism. The adjusting mechanism is a three-shaft mechanism with three components rotatable with respect to one another. In this case, the first component of the mechanism is connected fixedly in terms of rotation to the driving wheel and the second component is connected fixedly in terms of rotation to the driven part. The third component is designed, for example, as a toothed component, the rotational speed of which can be regulated via a shaft, for example by means of an electric motor or a braking device.

The torque is transmitted from the crankshaft to the first component and from there to the second component and consequently to the camshaft. This takes place either directly or with the third component being interposed.

By the rotational speed of the third component being suitably regulated, the first component can be rotated with respect to the second component, and consequently the phase position between the camshaft and crankshaft can be varied. Examples of three-shaft mechanisms of this type are inner eccentric mechanisms, double inner eccentric mechanisms, harmonic drives, swashplate mechanisms or the like.

To control the camshaft adjuster, sensors detect the characteristic data of the internal combustion engine, such as, for example, the load state, the rotational speed and the angular positions of the camshaft and crankshaft. These data are fed to an electronic control unit which, after comparing the data with a characteristic map of the internal combustion engine, controls the adjusting motor of the camshaft adjuster.

DE 102 36 507 discloses a device for varying the control times of an internal combustion engine, in which torque transmission from the crankshaft to the camshaft and the adjusting operation are implemented by means of a swashplate mechanism. The device consists essentially of a camshaft wheel, of a camshaft-fixed rotary disk and of a swashplate mechanism. The camshaft wheel is drive-connected to a crankshaft and is produced in one piece with a housing. The swashplate is mounted on an adjusting shaft at a defined angle of incidence and is drive-connected to the housing.

The swashplate and the rotary disk are provided, on their axial side faces in each case facing the other component, in each case with a bevel wheel toothing in the form of a toothed rim. In this case, the swashplate and the rotary disk are arranged in such a way that, because of the mounting of the swashplate on the adjusting shaft at a specific angle of incidence, an angular segment of the toothing of the swashplate engages into an angular segment of the toothing of the rotary disk. There is, in this case, a difference in the number of teeth of the bevel wheel toothings.

The adjusting shaft is drive-connected to a drive unit, for example an electric motor, which drives it at a continuously regulatable rotational speed. A rotation of the adjusting shaft in relation to the rotary disk leads to a wobbling rotation of the swashplate and consequently to a rotation of the engaged angular segment in relation to the rotary disk and to the swashplate. On account of the different number of teeth of the bevel wheel toothings, this leads to a relative rotation of the camshaft with respect to the crankshaft.

If the amount of the relative angle of rotation between the camshaft and crankshaft overshoots a specific value, the internal combustion engine can no longer operate reliably. In the event of an extreme offset, the pistons may knock against the open gas exchange valves, thus leading to engine damage. Phase positions of this kind may occur, for example, due to a failure of the control unit or of the drive of the adjusting shaft or in the case of damage to the device itself. In order to prevent the offset between the angle of rotation of the crankshaft and the angle of rotation of the camshaft from becoming too great, means are provided for limiting the relative angle of rotation of the camshaft with respect to the crankshaft. For this purpose, the rotary disk connected at the camshaft is provided with a clearance, into which a stop arranged on the camshaft wheel engages. The stop may be produced in one piece with the camshaft wheel or be fastened to the latter.

This embodiment has the disadvantage that the stop has to be designed with a very high mass in order to withstand the high forces occurring in the event of a malfunction of the device. This leads to a large mass of the device and to high production costs. Furthermore, this principle proves to be inflexible in terms of the manufacture of various devices having different adjustment angle ranges.

OBJECT OF THE INVENTION

The object on which the invention is based is to provide a device for varying the control times of gas exchange valves of an internal combustion engine with angle-of-rotation limitation, while the mass and the costs of the device are to be reduced. At the same time, high torques are to be capable of being transmitted by the angle-of-rotation limitation. Furthermore, it is to become possible to implement devices having different adjustment angle ranges by means of the same components. This leads to shorter set-up times of the production machines during production and to lower stockkeeping.

SUMMARY OF THE INVENTION

In a first embodiment of a device for varying the control times of gas exchange valves of an internal combustion engine, with a driving wheel drive-connected to a crankshaft, and with a swashplate mechanism which has a driven element drive-connected to a camshaft, the object is achieved, according to the invention, in that more than one pairing of a first and of a second boundary wall are provided, a finger being provided for each pairing, each finger engaging between the boundary walls of a pairing, the boundary walls being connected fixedly in terms of rotation either to the driving wheel or to the driven element and the fingers being connected fixedly in terms of rotation to the other component, the boundary walls and the fingers being designed and arranged with respect to one another in such a way that, when a maximum permissible value of the relative phase position of the crankshaft with respect to the camshaft is reached, each finger comes to bear against one of the boundary walls.

In an embodiment of the invention, there is provision for the clearances to be designed identically.

During an operation to adjust the swashplate mechanism, the housing and driving wheel, as components drive-connected to the crankshaft, are rotated in relation to the driven element connected fixedly in terms of rotation to the camshaft. For limiting the angle of rotation, fingers are formed on the driven element, each finger being arranged between two boundary walls. The boundary walls are connected fixedly in terms of rotation to the housing or to the driving wheel. It is likewise conceivable to produce the boundary walls in one piece with the housing or with the driving wheel. A further possibility is to form the fingers on the housing or the driving wheel and to fasten the boundary walls fixedly in terms of rotation to the driven element or to produce them in one piece with the latter.

When a relative rotation takes place between the driven element and the housing or the driving wheel, the fingers travel between the boundary walls in the circumferential direction. The boundary walls and the fingers are designed and mounted with respect to one another in such a way that each of the fingers comes to bear against one of the two respective boundary walls when a maximum permissible relative angle between the camshaft and crankshaft is reached. This prevents a further increase in the relative angle.

By a plurality of fingers being formed, which engage in each case into a clearance, the torques to be transmitted are distributed to a plurality of locations and therefore the forces which a finger has to transmit are minimized, thus leading to lower wear and to an increased service life of the device.

The boundary walls may be formed by clearances which are produced on an inner surface area or outer surface area of a stop disk. The stop disk may be a separately produced component which is fastened fixedly in terms of rotation to the driven element or driving wheel on the device. It is likewise conceivable to produce the stop disk in one piece with the driven element, the driving wheel or the housing.

In a second embodiment of a device for varying the control times of gas exchange valves of an internal combustion engine, with a drive unit drive-connected to a crankshaft and comprising at least one driving wheel, and with a swashplate mechanism which has at least one driven element drive-connected to a camshaft, the object is achieved, according to the invention, in that means limiting the angle of rotation are provided, which limit the relative rotation of the driving wheel with respect to the driven element, angle-of-rotation ranges of different size being capable of being set, during the mounting of the device, by the driven element being oriented with the driving wheel.

For this purpose, the device is provided with a plurality of means limiting the angle of rotation, one group being connected fixedly in terms of rotation to the driven element and a second group being connected fixedly in terms of rotation to the driving wheel or to a component connected fixedly in terms of rotation to the driving wheel. During mounting, the driven element can be mounted in different angular positions with respect to the driving wheel. The means limiting the angle of rotation are formed on the device in such a way that, in any mounting position of the driving wheel with respect to the driven element, other groups of means limiting the angle of rotation can interact. If the adjustment angle range of different groups of means limiting the angle of rotation is designed differently, the desired adjustment angle range can be set, during mounting, by the driving wheel being positioned with respect to the driven element. The same components can therefore be utilized for devices having different angle-of-rotation ranges.

In a first embodiment of this invention, there is provision for a finger and at least two pairings of a first and of a second boundary wall to be provided, the boundary walls being connected fixedly in terms of rotation either to an inner surface area of the drive unit or to an outer surface area of the driven element, and the finger being connected fixedly in terms of rotation to the respective surface area of the other component, the spacings between the boundary walls of various pairings being designed differently, and, in the mounted state of the device, the finger being arranged between the boundary walls of one of the pairings.

The pairings of boundary walls may be implemented, for example, by clearances in a stop disk.

The functioning of this embodiment is similar to the functioning of the first embodiment. Once again, pairings of boundary walls are provided. However, the pairings differ from one another in the spacing of their boundary walls in the circumferential direction. furthermore, the device has arranged on it only one finger which, in the mounted state, engages between the boundary walls of one of the pairings and consequently forms the angle-of-rotation limitation.

The individual components of the device are designed in such a way that, during mounting, the finger can be arranged in any desired clearance. The adjustment angle range of each device can thereby be adapted to the special application, while the same components can be used for various applications. Individualization is carried out, during the mounting of the device, solely by the individual components being mounted in the correct angular relation, with the result that the finger is positioned in the correct clearance.

In a second embodiment of this invention, there is provision for more than one finger and a first and a second boundary wall to be provided, the boundary walls being connected fixedly in terms of rotation either to an inner surface area of the drive unit or to an outer surface area of the driven element, and the fingers being connected fixedly in terms of rotation to the respective surface area of the other component, the width of the fingers being designed differently in the circumferential direction, and, in the mounted state of the device, one of the fingers being arranged between the boundary walls.

This embodiment constitutes a reversal of the first embodiment. A "clearance" is provided which is delimited by the boundary walls. Fingers of different width can be fitted into this "clearance". The adjustment angle range arises from the width of the "clearance" and the width of the fingers.

In a third embodiment of this invention, there is provision for more than two fingers and a first and a second boundary wall to be provided, the boundary walls being connected fixedly in terms of rotation either to an inner surface area of the drive unit or to an outer surface area of the driven element, and the fingers being connected fixedly in terms of rotation to the respective surface area of the other component, and, in the mounted state of the device, one of the fingers cooperating with the first boundary wall and another of the fingers cooperating with the second boundary wall, in such a way that the adjustment angle range of the device is thereby limited.

The adjustment angle range is in this case limited by two fingers. Each finger limits the rotation of the driving wheel in relation to the driven element in one direction of rotation. If more than two fingers are provided, different permutations as to which finger cooperates with which boundary wall are possible. By virtue of the adapted arrangement of the fingers in the circumferential direction of the device, a plurality of adjustment angle ranges can be implemented by means of the same components.

By the same components being used for different applications, the production costs are lowered, since the same tools can be used, set-up times are avoided and stockkeeping is minimized.

In the embodiments described, the fingers and the clearances may be utilized for calibrating the actual angle value detected by the control. For this purpose, the device is rotated in one direction until the fingers bear reliably in each case against a boundary wall. Subsequently, the camshaft angle sensors are read out, and this value is used as a reference value for operating the internal combustion engine.

Advantageously, the boundary walls are formed by clearances in an inner surface area or outer surface area of a stop disk. The stop disk may be produced as a separately manufactured component and fastened to the device or be produced in one piece with one of its components. By the stop disk being used, the rigidity and consequently the load-bearing capacity of the boundary walls are increased.

In embodiments of the invention, there may be provision for the boundary walls to be produced in one piece with the driving wheel or for the drive unit to contain a housing and for the boundary walls to be produced in one piece with the housing. In this case, there may be provision for producing the finger or fingers in one piece with the driven element.

Alternatively, the boundary walls may be produced in one piece with the driven element, in which case there may additionally be provision for the finger or fingers to be produced in one piece with the driving wheel or for the drive unit to contain a housing and for the finger or fingers to be produced in one piece with the housing.

BRIEF DESCRIPTION OF THE DRAWINGS

Further features of the invention may be gathered from the following description and the accompanying drawings which illustrate exemplary embodiments of the invention diagrammatically and in which.

DETAILED DESCRIPTION OF THE INVENTION

Figure 1:
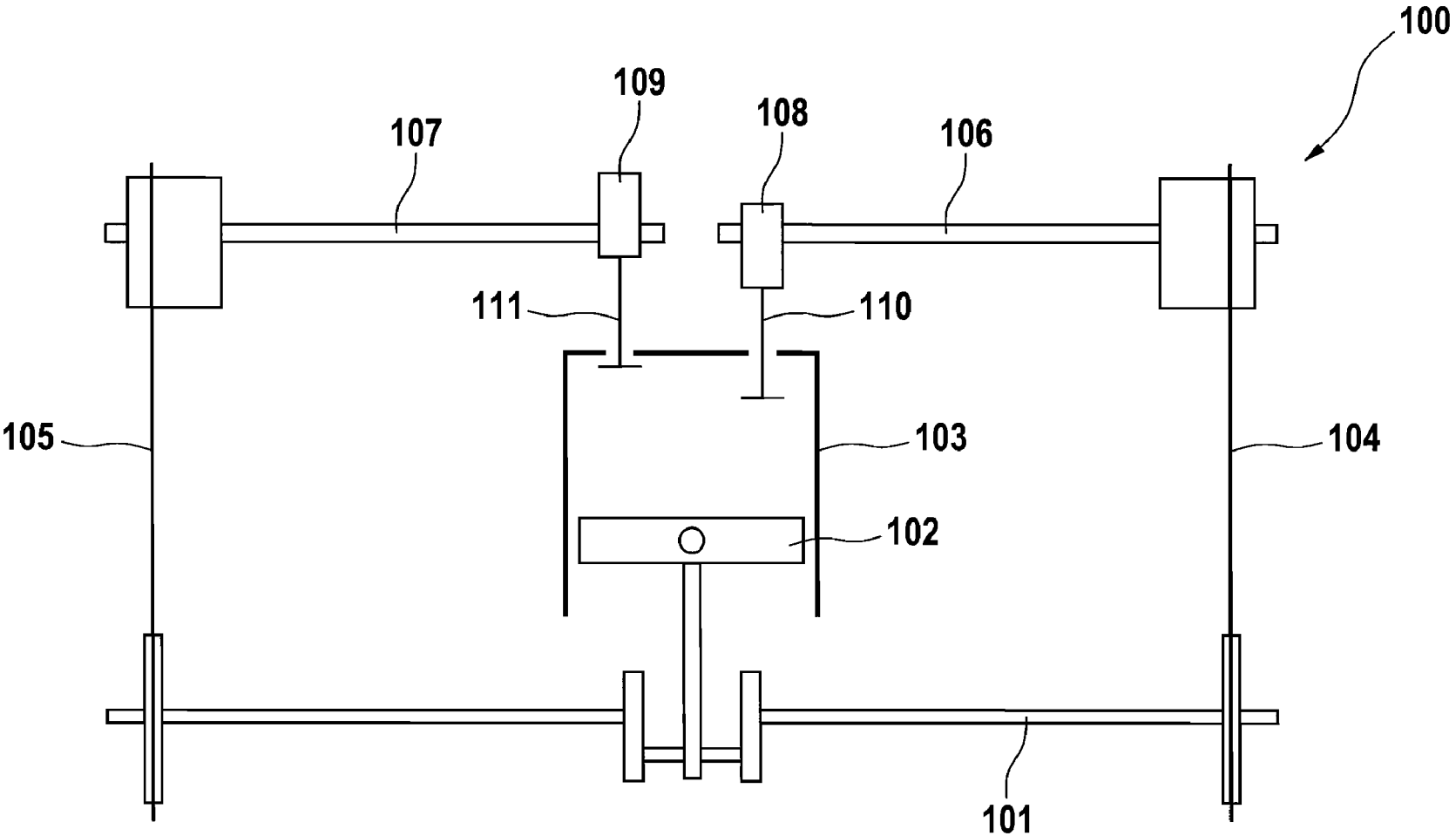
FIG. 1 shows an internal combustion engine only highly diagrammatically.

An internal combustion engine 100 is outlined in FIG. 1, a piston 102 connected to a crankshaft 101 being indicated in a cylinder 103. In the embodiment illustrated, the crankshaft 101 is connected, in each case via a traction mechanism 104 and 105, to an intake camshaft 106 and an exhaust camshaft 107, a first and a second device 1 being capable of ensuring a relative rotation between the crankshaft 101 and camshafts 106, 107. Cams 108, 109 of the camshafts 106, 107 actuate an intake gas exchange valve 110 and the exhaust gas exchange valve 111.

Figure 1A:
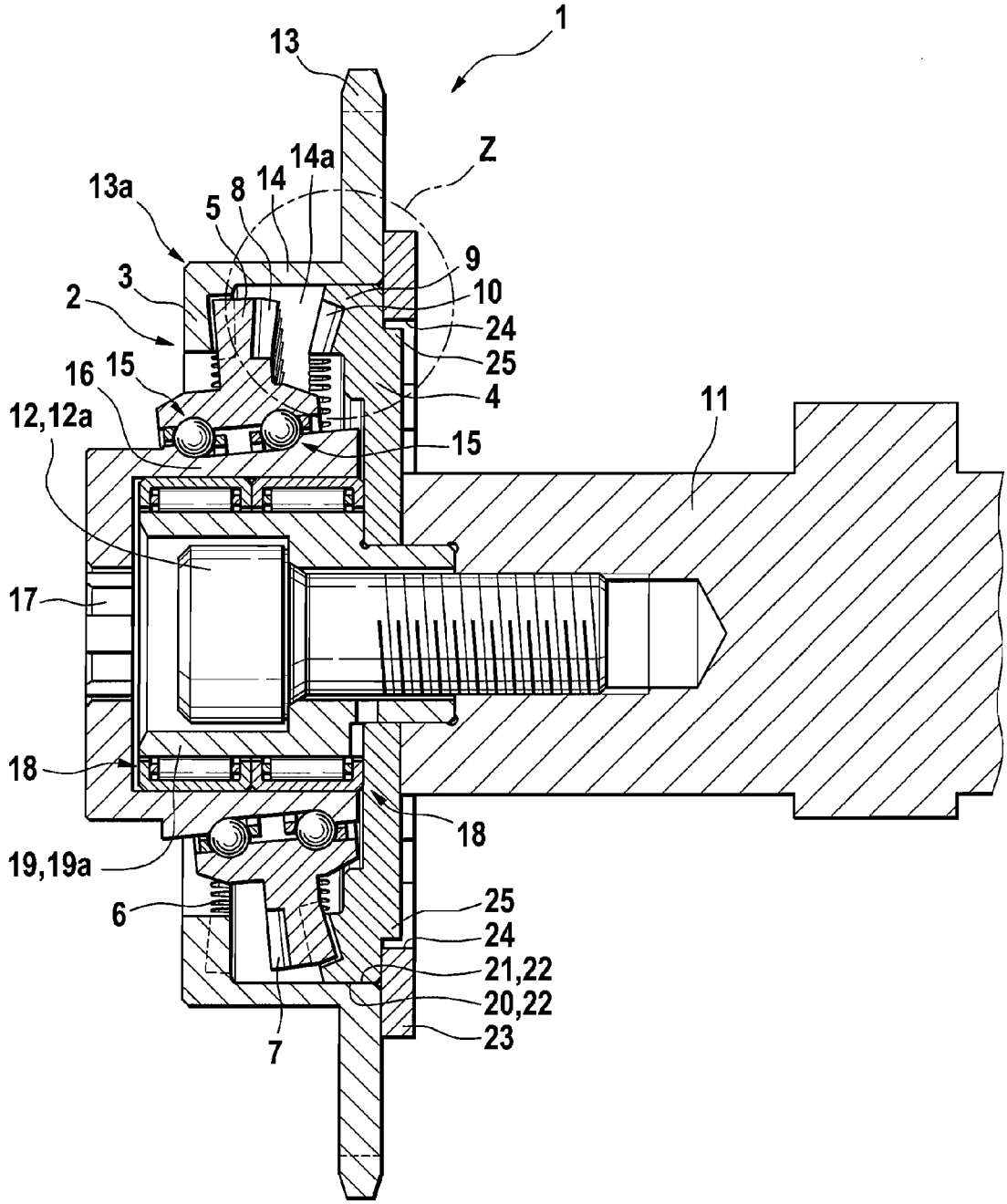
FIG. 1*a* shows a longitudinal section through a first embodiment according to the invention of a device for varying the control times of gas exchange valves of an internal combustion engine, the device being mounted on a camshaft.
Figure 1B:
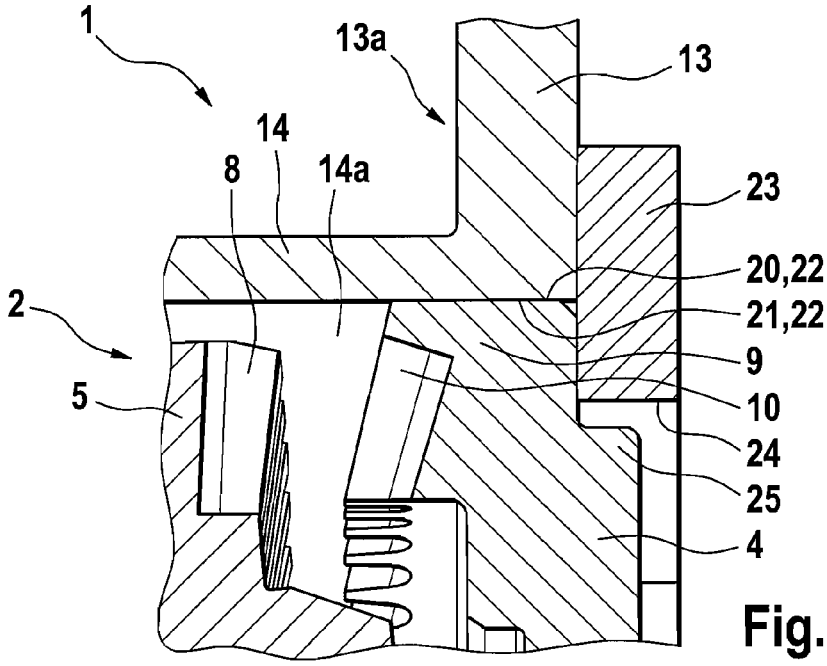
FIG. 1*b* shows an enlarged illustration of the detail Z marked in FIG. 1.
Figure 2:
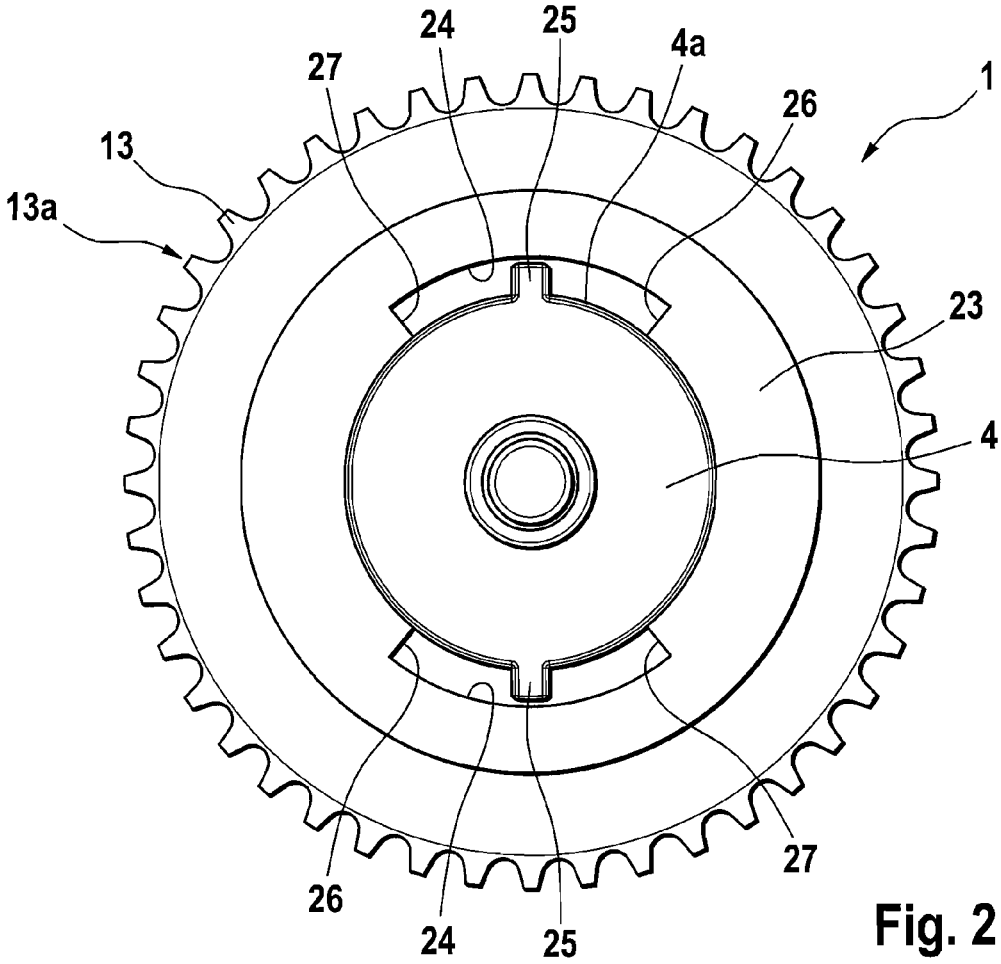
FIG. 2 shows an illustration of the device according to the invention from FIG. 1 in a front view.

FIGS. 1*a*, 1*b* and 2 show an embodiment of a device 1 according to the invention for varying the control times of an internal combustion engine 100. The device 1 comprises, inter alia, a swashplate mechanism 2 comprising a driving bevel wheel 3, of a driven element 4 and of a swashplate 5. A first toothed rim 6 designed as a bevel wheel toothing is formed on one axial side face of the driving bevel wheel 3. Furthermore, a second and a third toothed rim 7, 8 are formed on the axial side faces of the swashplate 5, in this exemplary embodiment the toothed rims 7, 8 likewise being designed in each case as a bevel wheel toothing. In this instance, the second toothed rim 7 is formed on the axial side face, facing the driving bevel wheel 3, of the swashplate 5 and the third toothed rim 8 is formed on the axial side face, facing the driven element 4, of said swashplate 5. The radially outer portion of the driven element 4 is designed as a toothing carrier 9, on the axial side face of which, facing the swashplate 5, a fourth toothed rim 10 is formed. In this embodiment, the fourth toothed rim 10 is likewise designed as a bevel wheel toothing.

The driven element 4 is connected fixedly in terms of rotation to a camshaft 11. In the exemplary embodiment illustrated, the connection between the driven element 4 and camshaft 11 is implemented by means of a first fastening means 12, here a fastening screw 12*a*. Materially integral, nonpositive, frictional or positive connection methods may likewise be envisaged.

A driving wheel 13 is operatively connected to a primary drive, not illustrated, via which a torque is transmitted from a crankshaft 101 to the driving wheel 13. A primary drive of this type may be, for example, a chain, belt or gearwheel mechanism. The driving wheel 13 is connected fixedly in terms of rotation to a housing 14, and the housing 14 is, in turn, connected fixedly in terms of rotation to the driving bevel wheel 3. In the embodiment illustrated in FIG. 1, these components are produced in one piece. It is likewise conceivable to produce the components separately and to have a fastening by means of screws or nonpositive, positive, frictional or materially integral connection methods. The driving wheel 13, the housing 14 and the driving bevel wheel 3 form a drive unit 13*a* which is drive-connected to the crankshaft 101.

The driving bevel wheel 3 and the driven element 4 stand parallel to one another and are spaced apart from one another in the axial direction. Together with the housing 14, the driving bevel wheel 3 and the driven element 4 form an annular cavity 14*a* in which the swashplate 5 is arranged. By means of first rolling bearings 15, the swashplate 5 is mounted on an adjusting shaft 16 at a defined angle of incidence with respect to the driving bevel wheel 3 and to the driven element 4. The adjusting shaft 16, of essentially pot-shaped design, is provided with a coupling element 17, into which engages a shaft, not illustrated, of a device, likewise not illustrated, by means of which the rotational speed of the adjusting shaft 16 can be regulated. In this embodiment, there is provision for driving the adjusting shaft 16 by means of an electric motor, not illustrated, a shaft, not illustrated, of the electric motor cooperating with the coupling element 17. However, other devices for regulating the rotational speed of the adjusting shaft 16 may also be envisaged. The adjusting shaft 16 is supported via second rolling bearings 18 on a shaft 19*a* connected fixedly in terms of rotation to the camshaft 11 and designed in the present embodiment as a hollow shaft 19. It is likewise conceivable to mount the adjusting shaft 16 on a screw head of the fastening screw 12*a* and/or to mount the swashplate 5 on the adjusting shaft 16 by means of a plain bearing.

The swashplate 5 arranged at a defined angle of incidence on the adjusting shaft 16 engages with the second toothed rim 7 into the first toothed rim 6 of the driving bevel wheel 3 and with the third toothed rim 8 into the fourth toothed rim 10 of the driven element 4. In this case, the respective toothed rims 6, 7, 8, 10 are in engagement in each case only in a specific angular range, the size of the angular range being dependent on the angle of incidence of the swashplate 5.

Via the engagement of the toothed rims 6, 7, 8, 10, the torque of the crankshaft 101, transmitted from the primary drive to the driving wheel 13 and from there to the driving bevel wheel 3, is transmitted via the swashplate 5 to the driven element 4 and consequently to the camshaft 11.

If the adjusting shaft 16 is driven by means of an electric motor via a shaft engaging into the coupling element 17, the adjusting shaft 16 is driven at the rotational speed of the driving wheel 13, in order to keep the phase position between the camshaft 11 and crankshaft 101 constant. If the phase position is to be changed, the rotational speed of the adjusting shaft 16 is increased or reduced, depending on whether the camshaft 11 is to lead or lag in relation to the crankshaft 101. Owing to the deviating rotational speed of the adjusting shaft 16, the swashplate 5 executes a wobbling rotation, the angular ranges in which the toothed rims 6, 7, 8, 10 engage one in the other rotating around the swashplate 5, the driving bevel wheel 3 and the driven element 4. In the case of at least one of the pairs of toothed rims, the two toothed rims 6, 7, 8, 10 engaging one in the other have different numbers of teeth. When the angular ranges in which the toothed rims 6, 7, 8, 10 engage one in the other have rotated once around the swashplate 5 completely, this results, on account of the difference in the number of teeth, in an adjustment of the driving bevel wheel 3 with respect to the driven element 4 and consequently of the camshaft 11 in relation to the crankshaft 101. The adjustment angle corresponds to the range occupied by the teeth forming the difference in the number of teeth.

It is conceivable, in this respect, that the toothed rims 6, 7, 8, 10, engaging one in the other, of the two pairs of toothed rims have different numbers of teeth. The adjustment reduction ratio consequently arises from the two resulting reduction ratios.

It is likewise conceivable that the toothed rims 6, 7, 8, 10 of only one pairing of toothed rims have different numbers of teeth. In this case, the reduction ratio arises only from this reduction. In this case, the other pairing of toothed rims serves merely as coupling means with a reduction ratio of 1:1 between the swashplate 5 and the respective component 3, 4.

During the adjustment operation, the driving wheel 13 or the housing 14 rotates with respect to the driven element 4 according to the reduction ratio of the swashplate mechanism 2 and the relative rotational speed of the adjusting shaft 16 with respect to the driving wheel 13. An outer surface area of the driven element 4 is designed as a first radial bearing surface 20. Furthermore, at least part of an inner surface area of the driving wheel 13 or of the housing 14 is designed as a second radial bearing surface 21. The two radial bearing surfaces 20, 21 cooperate as radial bearings 22, with the result that the driving wheel 13 and the housing 14 are mounted rotatably on the driven element 4.

While the internal combustion engine 100 is in operation, the phase position of the camshaft 11 in relation to the crankshaft 101 should be set only within a specific angular range. If higher angles than the maximum permissible extreme values are set, this leads, in the worst case, to the pistons of the internal combustion engine 100 knocking against the open gas exchange valves and to the internal combustion engine 100 consequently becoming inoperative.

These faulty settings of the phase position may be caused, for example, by the failure of the control of the device 1 or by the failure of the drive device or of the device 1 itself. In order to avoid this, means limiting the angle of rotation must be provided, which, in these exceptional cases, prevent a displacement of the phase position beyond predetermined extreme values.

An annular stop disk 23 is fastened to the camshaft-side end of the driving wheel 13. The stop disk 23 may be connected to the driving wheel 13 nonpositively, frictionally, materially integrally or positively. On its radially inner circumferential surface, the stop disk 23 is designed with two clearances 24 extending in the circumferential direction and in the radial direction. In each case a finger 25 produced in one piece with the driven element 4 extends into the clearance 24. The fingers 25, starting from an otherwise circular boundary surface 4*a* of the driven element 4, extend outward in the radial direction and may be produced with the driven element 4 during the process of forming the latter.

If, while the internal combustion engine 100 is in operation, the phase position between the crankshaft 101 and camshaft 11 is changed by means of the swashplate mechanism 2, the driven element 4 rotates in relation to the driving wheel 13. As a consequence, the driven element 4 is likewise rotated in relation to the stop disk 23 connected fixedly in terms of rotation to the driving wheel 13. The result of this is that the fingers 25 change their position within the clearances 24. In this case, the fingers 25 and the clearances 24 are designed in such a way that the fingers 25 come to bear against one of the two radial boundary walls 26, 27 of the respective clearance 24 when one of the two maximum permissible phase positions of the device 1 is reached. A further change in the phase position to larger angles is consequently prevented and the internal combustion engine 100 is protected from damage.

Furthermore, there is the possibility of integrating further functions into the stop disk 23, such as, for example, the axial mounting of the driving wheel 13 or of the housing 14 with respect to the driven element 4.

Figure 3:
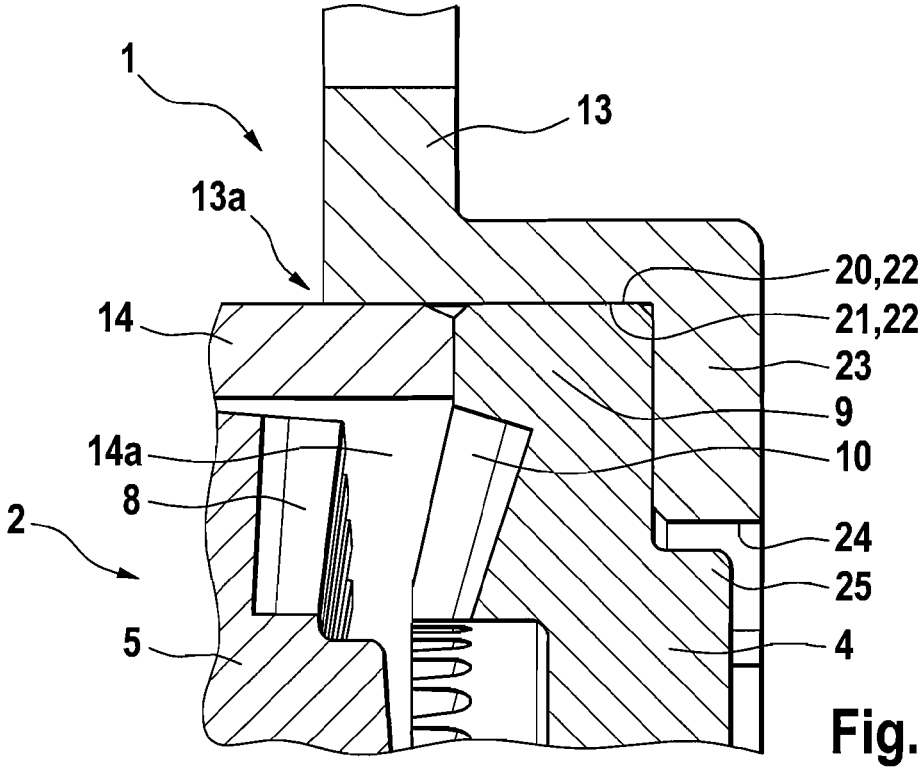
FIG. 3 shows an illustration of the detail Z, similar to FIG. 1*b*, of a second embodiment according to the invention of a device for varying the control times of gas exchange valves of an internal combustion engine.

FIG. 3 shows an enlarged illustration of a second embodiment according to the invention of a device 1, similar to the illustration from FIG. 1*b*. The second embodiment is essentially identical to the embodiment shown in FIG. 1*a*. In contrast to the first embodiment, in the second embodiment the chain wheel 13 is not produced in one piece with the housing 14, but is connected fixedly in terms of rotation to the latter. This may be ensured, for example, via nonpositive, frictional, positive or materially integral connections. Furthermore, the stop disk 23 is connected in one piece to the driving wheel 13. The stop disk 23 is again provided with clearances 24 into which fingers 25 engage, the fingers 25 being produced in one piece with the driven element 4.

Figure 4:
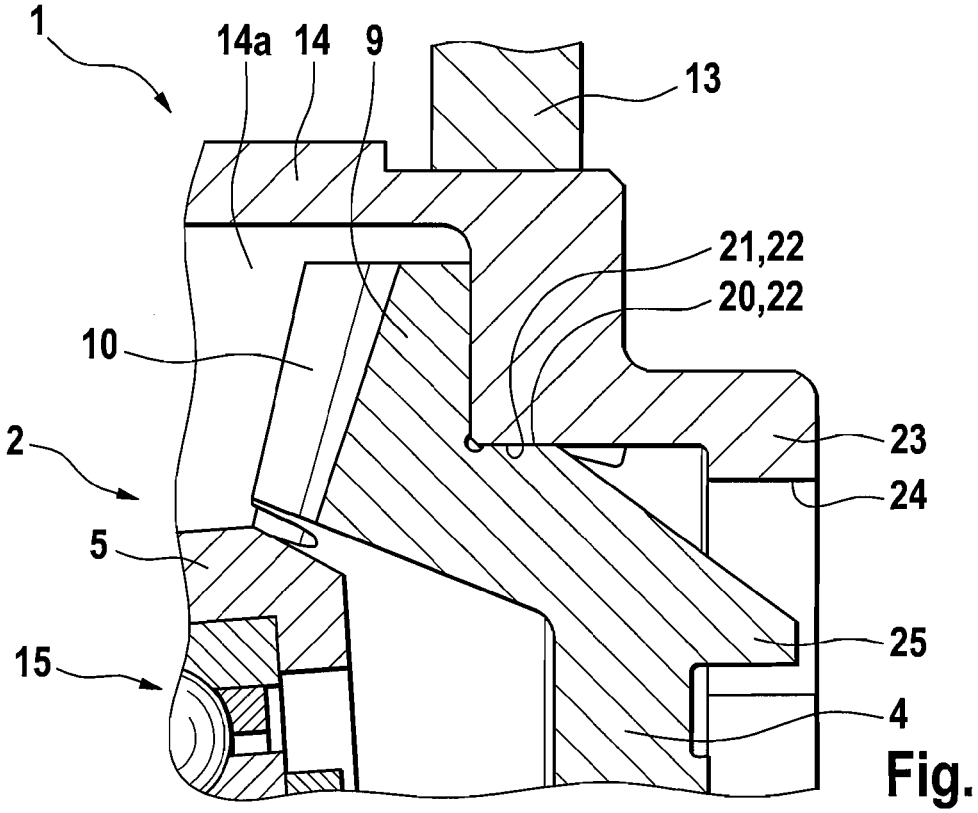
FIG. 4 shows an illustration of the detail Z, similar to FIG. 1*b*, of a third embodiment according to the invention of a device for varying the control times of gas exchange valves of an internal combustion engine.

FIG. 4 shows an enlarged illustration of a third embodiment according to the invention of a device 1 corresponding to the illustration from FIG. 1*b*. The third embodiment is again essentially identical to the first embodiment. In contrast to the first embodiment, here, the driving wheel 13 is produced as a separate component which is connected fixedly in terms of rotation to the housing 14. In this embodiment, the stop disk 23 is produced in one piece with the housing 14 and is again provided with clearances 24. Once again, in each case a finger 25 produced in one piece with the driven element 4 engages into the clearances 24. In this embodiment, the fingers 25 extend in the axial direction and are produced during the process of forming the driven element 4.

Figure 5:
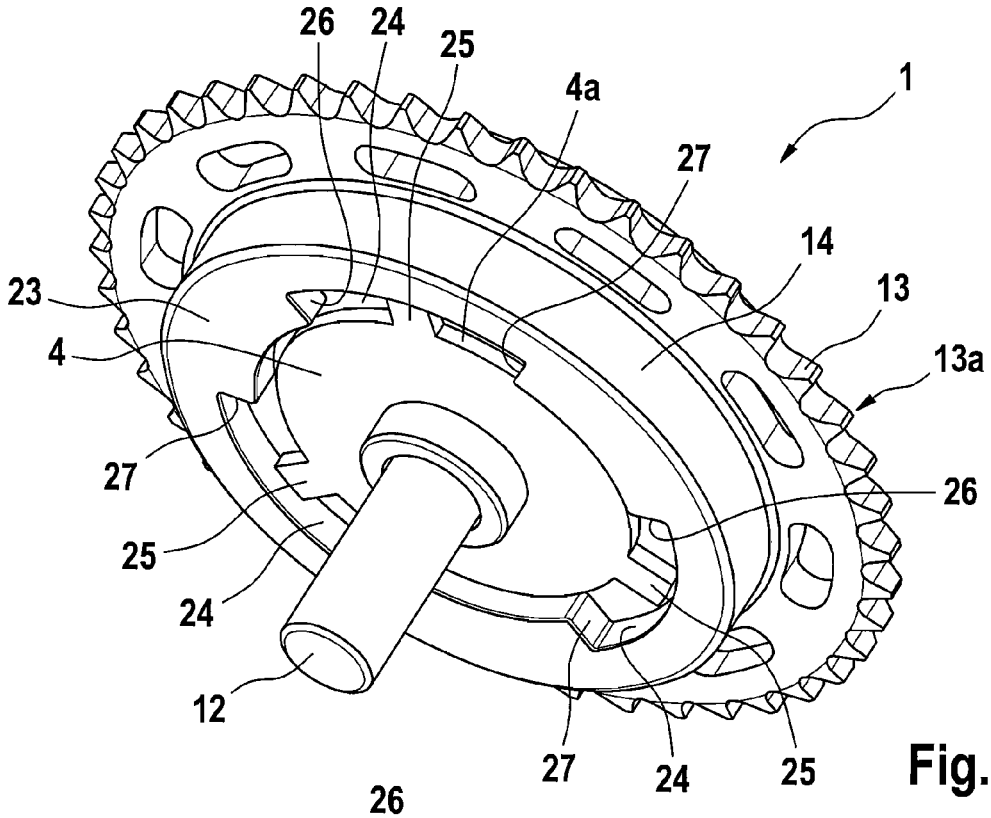
FIG. 5 shows a perspective illustration of a fourth embodiment according to the invention of a device for varying the control times of gas exchange valves of an internal combustion engine.

FIG. 5 shows a fourth embodiment of a device 1 according to the invention in a perspective view. This embodiment is distinguished in that the stop disk 23 is provided with a plurality of clearances 24, in this exemplary embodiment three, into which in each case a finger 25 produced in one piece with the driven element 4 engages. The clearances 24 are arranged, spaced apart from one another in the circumferential direction, and are designed identically. When the device 1 is in a state in which the camshaft 11 assumes a maximum permissible phase position with respect to the crankshaft 101, each finger 25 bears against one of the boundary walls 26, 27 of the respective clearance 24 and thus prevents a further rotation of the phase position beyond this extreme value.

Owing to the formation of a plurality of fingers 25, each finger 25 engaging into a clearance 24, the forces acting on the boundary walls 26, 27 and on the fingers 25 are minimized, thus increasing the service life of the device 1.

Figure 6:
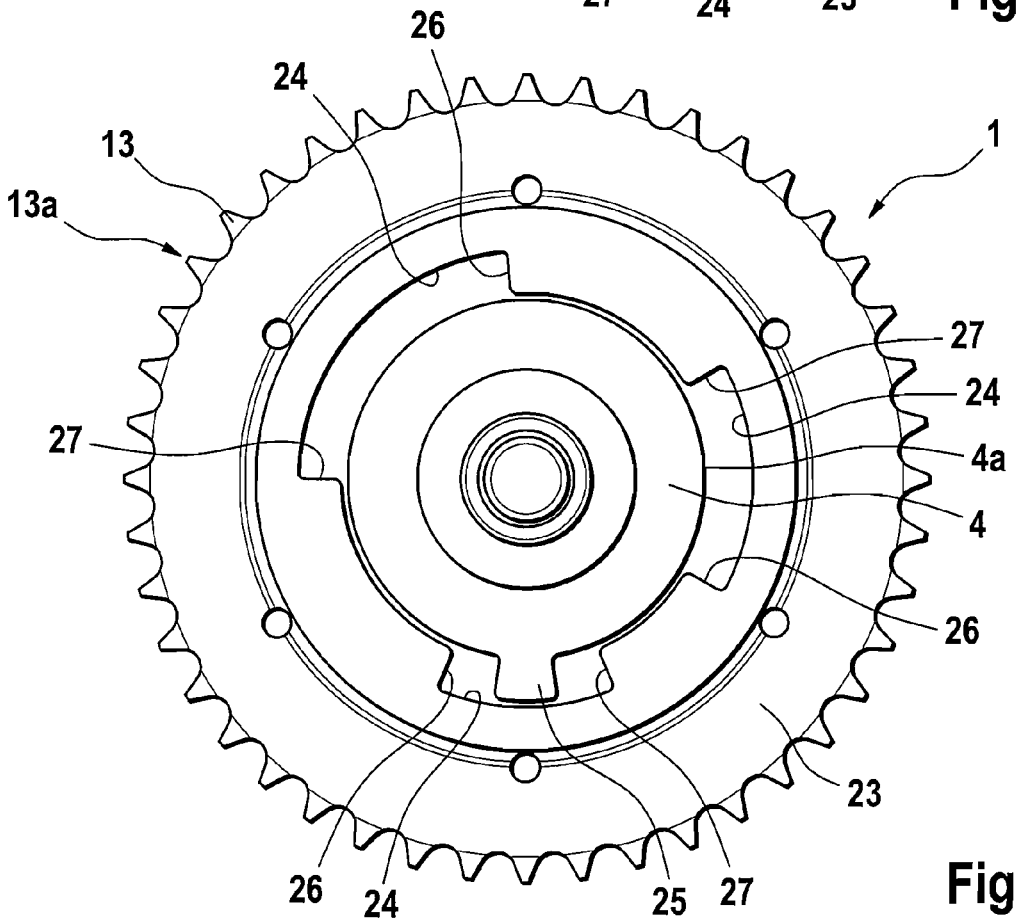
FIG. 6 shows a fifth embodiment according to the invention of a device for varying the control times of gas exchange valves of an internal combustion engine in a front view.

FIG. 6 shows a fifth embodiment of the invention, the device 1 being illustrated in a front view. In this case, once again, the stop disk 23 is provided with three clearances 24. In contrast to the fourth embodiment, the clearances 24 are designed with different lengths in the circumferential direction. In this case, only one finger 25 is formed on the driven element 4 and engages into one of the clearances 24. Different adjustment angle intervals can be implemented, depending on into which of the clearances 24 the finger 25 engages. By the stop disk 23 being designed with clearances 24 of different length, the multiplicity of components in production can be lowered. If, for example, devices 1 are required for the inlet camshaft and the outlet camshaft, in which case the device 1 for the inlet camshaft is to have an adjustment angle range other than that of the device 1 for the outlet camshaft, then the same driven elements 4 can be used for both devices 1, the various adjustment angle intervals being taken into account by the finger 25 engaging into the respective clearance 24. Production costs are thereby lowered, since both driven elements 4 can be manufactured by means of the same tool.

Figure 6A:
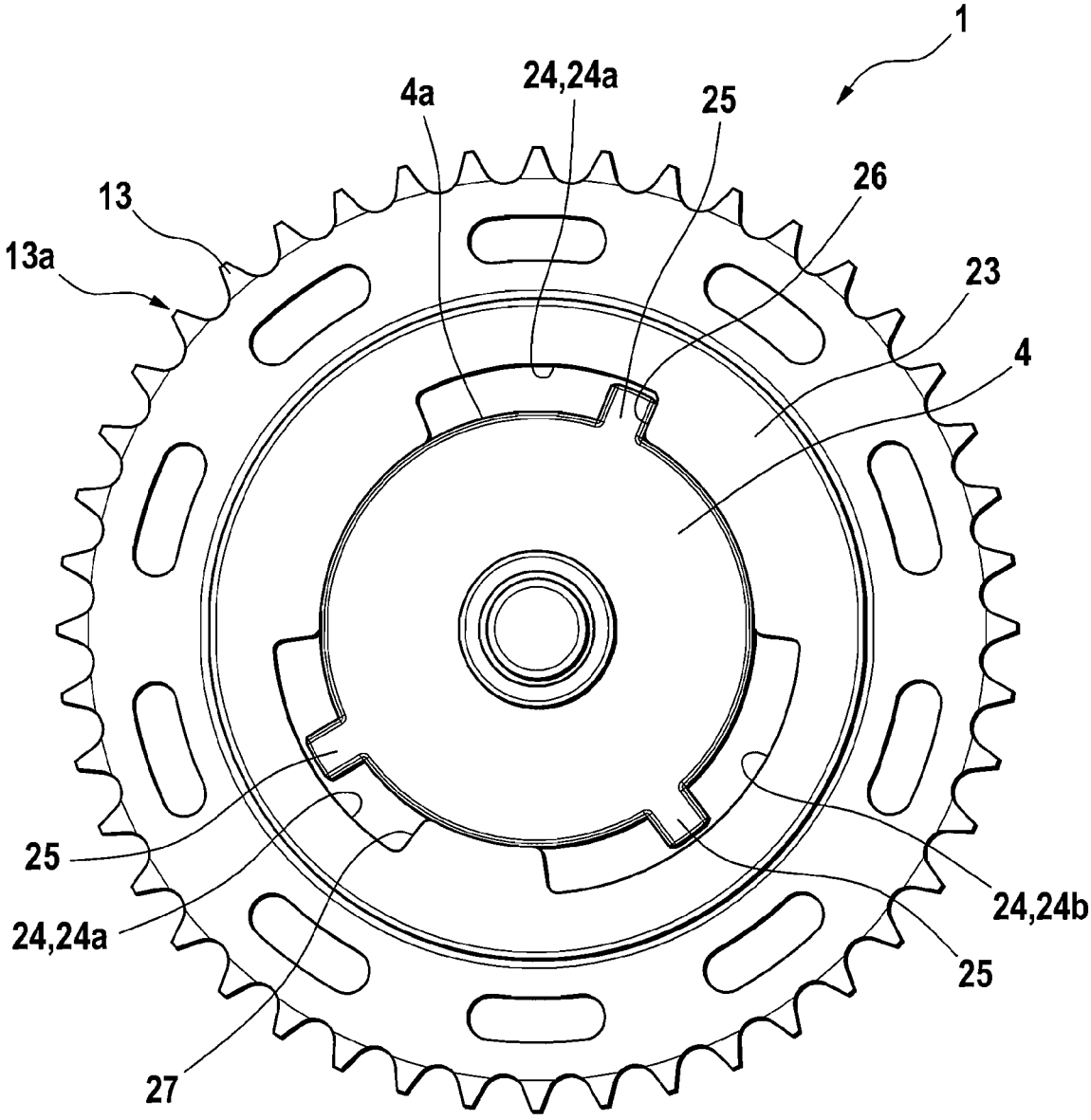
FIG. 6*a* shows a sixth embodiment according to the invention of a device for varying the control times of gas exchange valves of an internal combustion engine in a first extreme position in a front view.
Figure 6B:
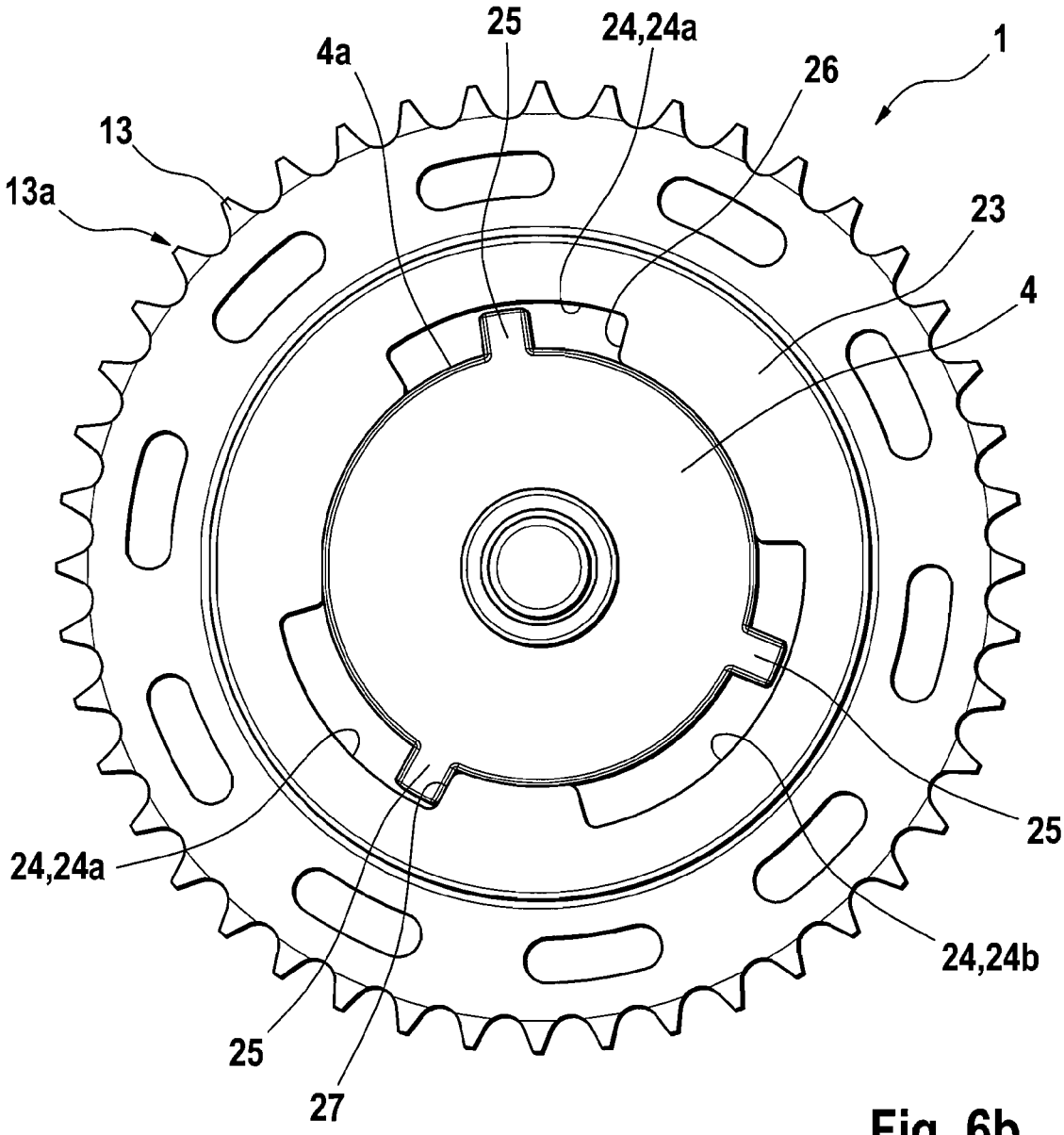
FIG. 6*b* shows a sixth embodiment according to the invention of a device for varying the control times of gas exchange valves of an internal combustion engine in a second extreme position in a front view.

FIGS. 6*a* and 6*b* show a sixth embodiment of the invention. In this embodiment, three fingers 25 are formed. Furthermore, three clearances 24 are formed. Each finger 25 engages into a clearance 24. In this case, two clearances 24 are designed as boundary clearances 24*a* and one is designed as an empty clearance 24*b*.

FIG. 6*a* shows the device 1 in a position in which the driven element 4 is in one of its two extreme positions with respect to the driving wheel 13. A finger 25 bears against a boundary wall 26 of the associated boundary clearance 24*a*, while the other fingers 25 are located within the respective clearance 24.

FIG. 6*b* shows the device 1 in the second extreme position. In this case, the other finger 25 bears against a boundary wall 27 of the associated boundary clearance 24*a*, while the other fingers 25 are located within the respective clearance 24.

In this case, two of the fingers 25, in interaction with the respective boundary clearance 24*a*, are responsible for the adjustment angle limitation, one of the fingers 25 limiting the adjustment angle in one direction of rotation and the other finger 25 limiting the adjustment angle in the other direction of rotation. Owing to the adapted arrangement of the fingers 25 and to the correct positioning of the driven element 4 with respect to the driving wheel 13, different pairs of fingers can assume the adjustment angle limitation function, with different adjustment angle ranges.

Figure 6C:
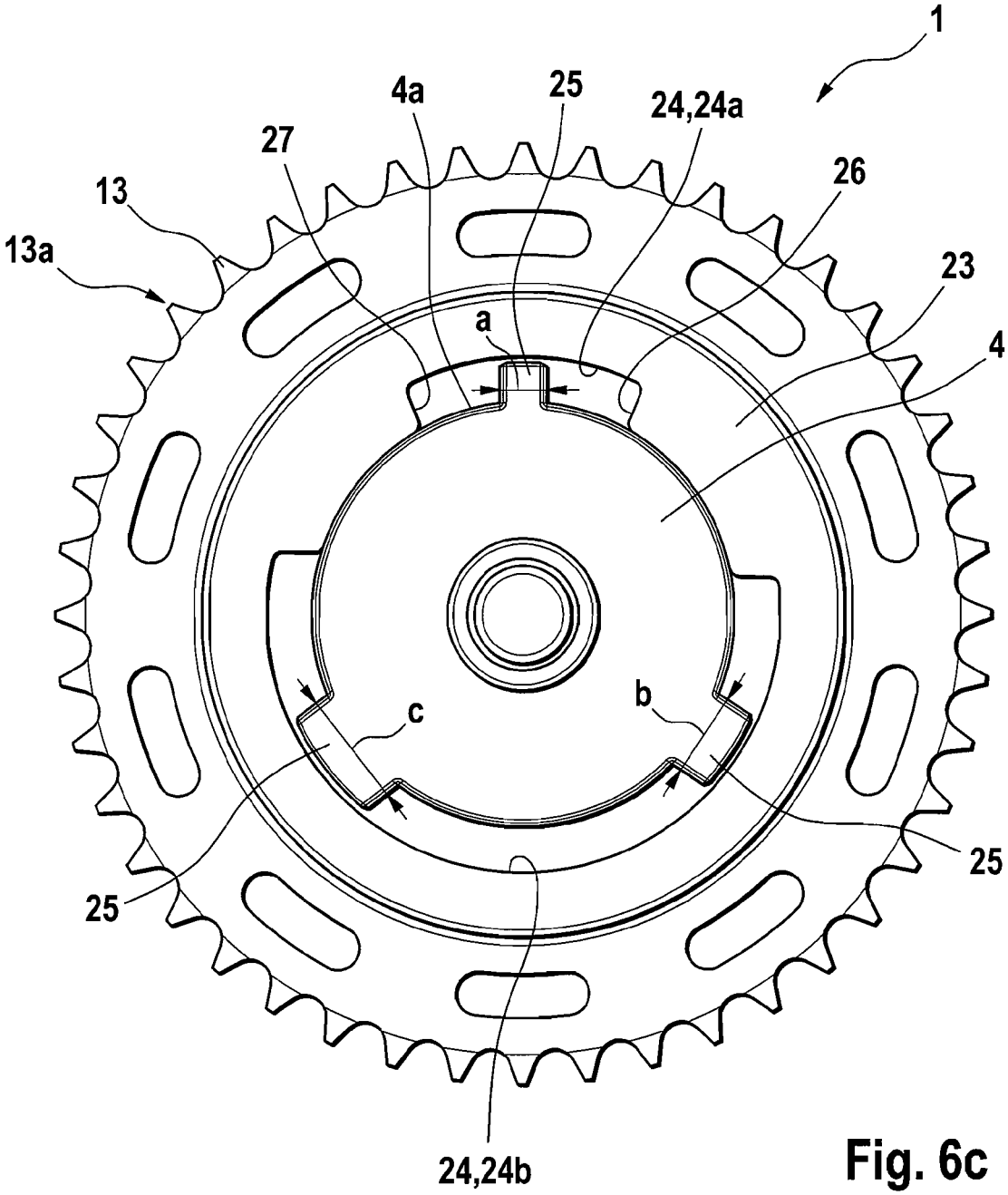
FIG. 6*c* shows a seventh embodiment according to the invention of a device for varying the control times of gas exchange valves of an internal combustion engine in a front view.
Figure 6D:
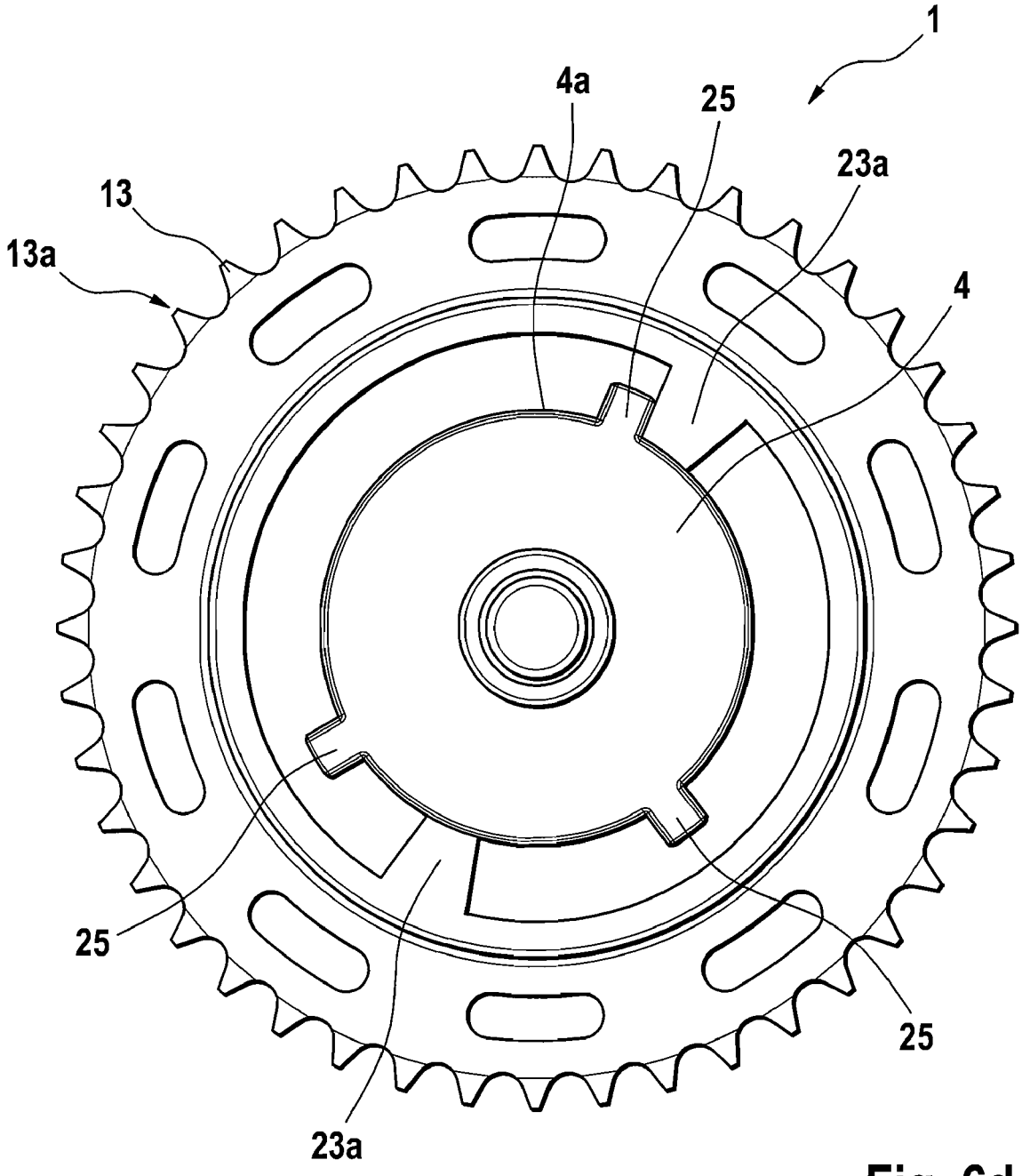
FIG. 6*d* shows an eighth embodiment according to the invention of a device for varying the control times of gas exchange valves of an internal combustion engine in a front view.

As an alternative to the embodiment illustrated, instead of the stop disk being used, noses 23*a* may be formed on the device, as illustrated in FIG. 6*d*. The noses 23*a* form boundary walls 26, 27 in a similar way to the clearances 24. This modification may, of course, also be employed in all the other embodiments described. The advantage of this version is a further reduction in the mass of the device 1. The noses 23*a* may be produced in one piece with a driven element 4, with the driving wheel 13 or with a component connected fixedly in terms of rotation to one of the two components. Separately manufactured noses 3*a* may likewise be envisaged, which are fastened to a component of the device 1 fixedly in terms of rotation, for example by means of screw connections or frictional, nonpositive, materially integral or positive connections.

FIG. 6*c* shows a seventh embodiment of the invention, the device 1 being illustrated in a front view. The stop disk 23 is in this case provided with two clearances 24. One of the clearances 24 is designed as a boundary clearance 24*a* shorter in the circumferential direction and the second clearance 24 is designed as an empty clearance 24*b* longer in the circumferential direction. In this case, three fingers 25 are formed on the driven element 4, the fingers 25 having different widths a, b, c in the circumferential direction. In the mounted state of the device 1, one of the fingers 25 engages into the boundary clearance 24*a* and the other two fingers 25 into the empty clearance 24*b*. In this case, the fingers 25 and the boundary clearance 24*b* are designed in such a way that a defined adjustment angle range is implemented by the interaction of the respective finger 25 with the boundary clearance 24*a*. In this case, there is provision for designing the length of the empty clearance 24*b* in the circumferential direction in such a way that the fingers 25 arranged in it do not come to bear against one of its boundary walls 26, 27. During the mounting of the device 1, the driven element 4 can be positioned in three positions in relation to the stop disk 23. In each position, another of the fingers 25 engages into the boundary clearance 24*a*, as a result of which, in this embodiment, three different adjustment ranges can be set by means of the same parts. In addition, there may be provision for the empty clearance 24*b* to be designed in such a way and the fingers 25 to be arranged in such a way that, at least in a relative positioning of the driven element 4 with respect to the stop disk 23, in each case one of the fingers 25 positioned in the empty clearance 24*b* comes to bear against one of its boundary walls 26, 27 when the finger 25 positioned in the boundary clearance 24*a* comes to bear against a boundary wall 26, 27 of the boundary clearance 24*a*.

Of course, the embodiments shown in FIGS. 1*a*, 3 and 4 may have the features of the embodiments illustrated in FIGS. 5 and 6, 6*a-c*.

Figure 7:
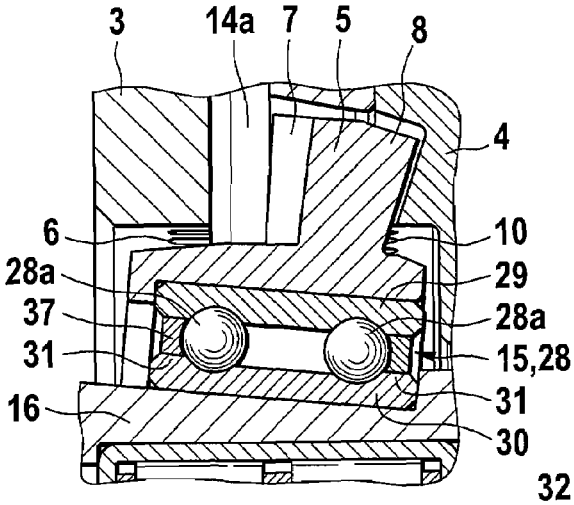
FIGS. 7-11 show different variants of the swashplate mounting in longitudinal section.
Figure 8:
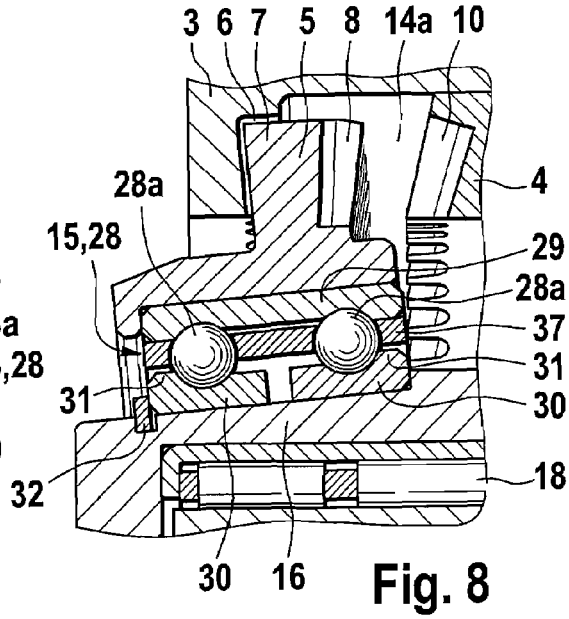

FIGS. 7 to 11 show various embodiments of the first rolling bearing 15 via which the swashplate 5 is mounted on the adjusting shaft 16. FIG. 7 shows a two-row inclined ball bearing 28. FIG. 8 shows a special embodiment of a two-row inclined ball bearing 28, there being only one outer ring 29 produced in one piece, while two inner rings 30 are provided. The advantage of this variant, as compared with the variant illustrated in FIG. 7, is that a larger number of balls can be used, and that higher shoulder heights of the shoulders 31 can be implemented.

The operating play of the two bearings is determined solely by the bearing clearance and the reduction in play due to the pressing together of the inner and the outer ring 29, 30 with the adjusting shaft 16 and the swashplate 5 and is lower than 0.1 mm. The spacing between the ball rows is determined by the corresponding spacing of the raceways in the bearing. The axial forces occurring are supported in the bearing itself. Whereas, in the embodiment from FIG. 7, the angle between the axes of the swashplate 5 and mechanism and also the slight pressing together of the bearing rings 29, 30 make an additional securing of the bearing against slipping out of place unnecessary, a spring ring 32 is additionally provided in the embodiment in FIG. 8.

Figure 9:
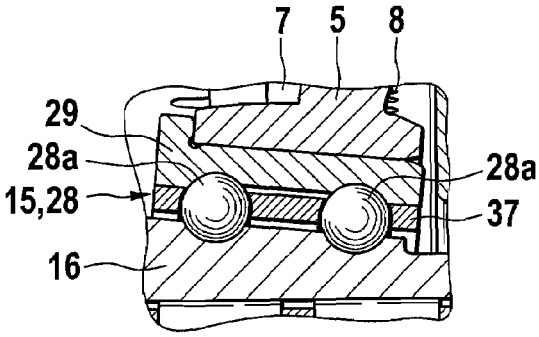

FIG. 9 shows a further embodiment of the first rolling bearing 15, which is once again a two-row inclined ball bearing 28, in this case an outer surface area of the adjusting shaft 16 serving as a raceway for the rolling bodies 28*a* of the inclined ball bearing 28. By means of this variant, the number of components and consequently the production costs are reduced. At the same time, by the outer ring 29 being employed, no heat treatment of the swashplate 5 is required, thus preventing a distortion caused by the introduction of heat and consequently leading to a higher accuracy of the toothing. Furthermore, when a bearing of this type is used, the swashplate 5 may be produced from a lightweight material, such as, for example, aluminum or plastic.

Figure 10:
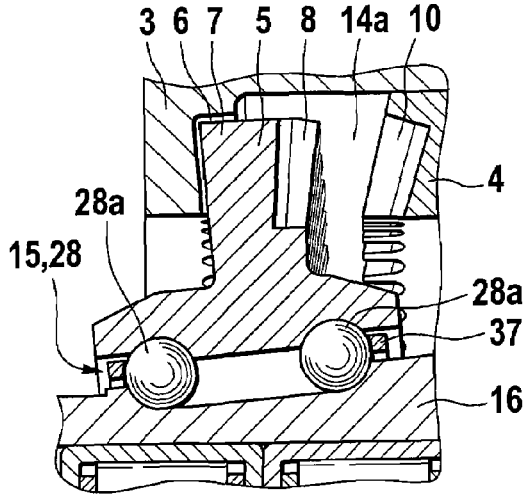

FIG. 10 shows a further embodiment of the first rolling bearing 15. In this embodiment, an inner surface area of the swashplate 5 and an outer surface area of the adjusting shaft 16 serve as a running surface for the rolling bodies 28*a*. In this case, again, there is a two-row inclined ball bearing 28. The advantage of this embodiment is that the operative surfaces for centering the bearing are dispensed with, with the result that the costs of producing the device 1 can be reduced.

Figure 11:
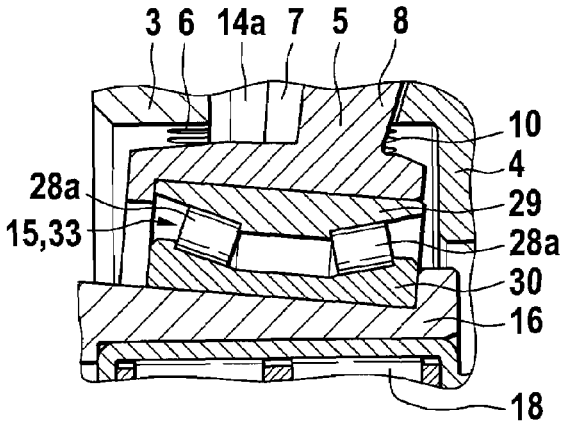

The use of a tapered roller bearing 33, as illustrated in FIG. 11, may likewise be envisaged.

All the illustrated embodiments of the first rolling bearing 15 may be designed, in general, in an O—, X— and tandem arrangement and with or without a bearing cage 37.

Figure 12:
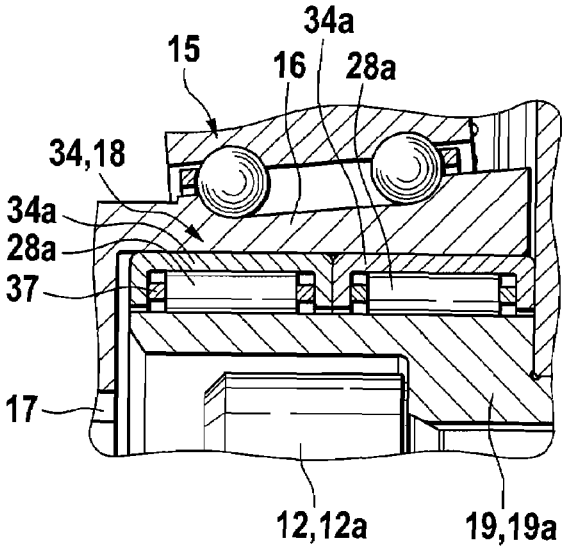
FIGS. 12-15 show different variants of the adjusting shaft mounting in longitudinal section.
Figure 13:
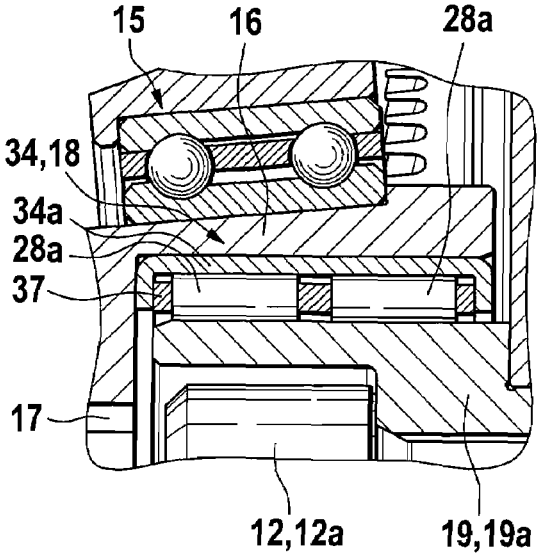
Figure 14:
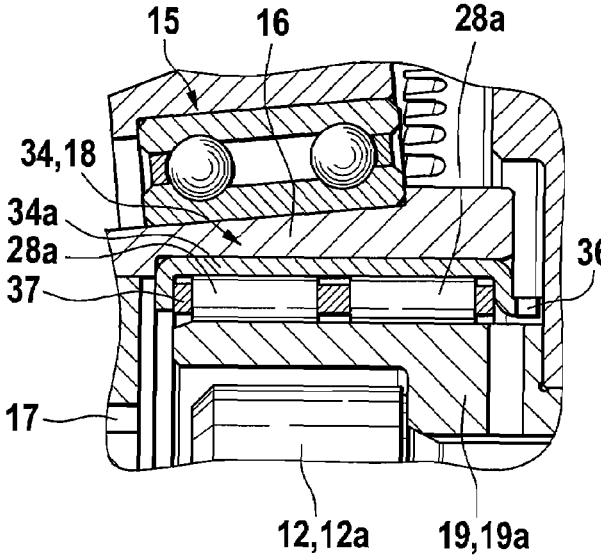

FIGS. 12 to 15 show various embodiments of the second rolling bearing 18. In FIGS. 12 to 14, needle bearings 34 are used in each case. In FIG. 12, two separate needle bearings 34 designed as needle sleeves are used, an outer surface area of the hollow shaft 19 forming the inner raceway and a sleeve 34*a* forming the outer running surface for the rolling bodies 28*a*. FIG. 13 shows an embodiment of a double-row needle bearing 34 in the embodiment of a needle sleeve. FIG. 14 shows an embodiment similar to FIG. 13, the needle 34 being designed with an extension 35, the extension 35 serving as a spacer for the axial determination of the needle sleeve. The integrated extension 35 may at the same time have punched-out portions or bores 36 which allow oil to flow radially through the extension 35. Alternatively, it would also be conceivable to lengthen a bearing cage 37 by means of the bearing housing.

The needle bearings 34 may be fixed by means of spring rings, a pressing together, caulking of the sleeve 34*a* in the bore, knurling of the sleeve 34*a* or an adhesive bond.

Figure 15:
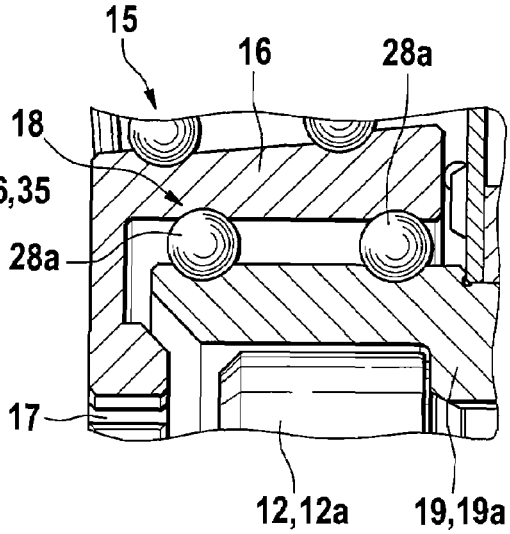

FIG. 15 shows a further embodiment of the second rolling bearing 18, a two-row ball bearing being provided here, and the running surfaces of the rolling bodies 28*a* being formed on the adjusting shaft 16 and on the hollow shaft 19. No axial securing is needed in this case.

LIST OF REFERENCE NUMERALS

1 Device
2 Swashplate mechanism
3 Driving bevel wheel
4 Driven element
4*a* Boundary surface
5 Swashplate
6 First toothed rim
7 Second toothed rim
8 Third toothed rim
9 Toothing carrier
10 Fourth toothed rim
11 Camshaft
12 First fastening means
12*a* Fastening screw
13 Driving wheel
13*a* Drive unit
14 Housing
14*a* Cavity
15 First rolling bearing
16 Adjusting shaft
17 Coupling element
18 Second rolling bearing
19 Hollow shaft
19*a* Shaft
20 First radial bearing surface
21 Second radial bearing surface
22 Radial bearing
23 Stop disk
23*a* Nose
24 Clearance
24*a* Boundary clearance
24*b* Empty clearance
25 Finger
26 First boundary wall
27 Second boundary wall
28 Inclined ball bearing
28*a* Rolling body
29 Outer ring
30 Inner ring
31 Shoulder
32 Spring ring
33 Tapered roller bearing
34 Needle bearing
34*a* Sleeve
35 Extension
36 Bore
37 Bearing cage
100 Internal combustion engine
101 Crankshaft
102 Piston
103 Cylinder
104 Traction mechanism
105 Traction mechanism
106 Inlet camshaft
107 Outlet camshaft
108 Cam
109 Cam
110 Inlet gas exchange valve
111 Outlet gas exchange valve
a Width
b Width
c Width

The invention claimed is:

1. A device for varying the control times of gas exchange valves of an internal combustion engine, comprising:

a driving wheel drive-connected to a crankshaft, and with a swashplate mechanism which has a driven element drive-connected to a camshaft, at least two pairings of first and second boundary walls are provided, a finger being provided for each of the pairings, each of the fingers engaging between the boundary walls of respective ones of the pairings, the boundary walls being connected fixedly in terms of rotation either to the driving wheel or to the driven element, and the fingers being connected fixedly in terms of rotation to the other of the driving wheel or the driven element, the boundary walls and the fingers being arranged with respect to one another in such a way that, when a maximum permissible value of a relative phase position of the crankshaft with respect to the camshaft is reached, each of the fingers comes to bear against one of the boundary walls.

2. The device as claimed in claim 1, wherein the boundary walls are formed by clearances in an inner surface area or outer surface area of a stop disk.

3. The device as claimed in claim 1, wherein the boundary walls are produced in one piece with the driving wheel.

4. The device as claimed in claim 3, wherein the finger or fingers is or are produced in one piece with the driven element.

5. The device as claimed in claim 1, wherein the drive unit contains a housing, and the boundary walls are produced in one piece with the housing.

6. The device as claimed in claim 1, wherein the boundary walls are produced in one piece with the driven element.

7. The device as claimed in claim 6, wherein the finger or fingers is or are produced in one piece with the driving wheel, or in that the drive unit contains a housing, and the finger or fingers is or are produced in one piece with the housing.

8. A device for varying the control times of gas exchange valves of an internal combustion engine, comprising:

a drive unit drive-connected to a crankshaft and comprises at least one driving wheel, and a swashplate mechanism which has at least one driven element drive-connected to a camshaft, and means limiting an angle of rotation which limit a relative rotation of the driving wheel with respect to the driven element, wherein angle-of-rotation ranges of different size are settable during mounting of the device, by changing an assembly orientation of the driven element with respect to the driving wheel.

9. The device as claimed in claim 8, wherein a finger and at least two pairings of a first and of a second boundary wall are provided, the boundary walls being connected fixedly in terms of rotation either to an inner surface area of the drive unit or to an outer surface area of the driven element, and the finger being connected fixedly in terms of rotation to a respective surface area of the other of the inner surface area of the drive unit or the outer surface area of the driven element, spacings between the boundary walls of the at least two pairings being different, and in a mounted state of the device, the finger being arranged between the boundary walls of one of the pairings.

10. The device as claimed in claim 8, wherein a plurlality of fingers and first and the second boundary walls are provided, the boundary walls being connected fixedly in terms of rotation either to an inner surface area of the drive unit or to an outer surface area of the driven element, and the fingers being connected fixedly in terms of rotation to a respective surface area of the other of the inner surface area of the drive unit or the outer surface area of the driven element, a width of the fingers being different in a circumferential direction, and in a mounted state of the device, one of the fingers being arranged between the boundary walls.

11. The device as claimed in claim 8, wherein a plurality of fingers and a plurality of first and the second boundary walls are provided, the boundary walls being connected fixedly in terms of rotation either to an inner surface area of the drive unit or to an outer surface area of the driven element, and the fingers being connected fixedly in terms of rotation to a respective surface area of the other of the inner surface area of the drive unit or the outer surface area of the driven element, and in a mounted state of the device, one of the fingers cooperating with the first boundary wall and another of the fingers cooperating with the second boundary wall, in such a way that an adjustment angle range of the device is thereby limited.

* * * * *